US010086914B2

(12) United States Patent
Gelin et al.

(10) Patent No.: US 10,086,914 B2
(45) Date of Patent: Oct. 2, 2018

(54) SYSTEM FOR TRANSFERRING FLUID BETWEEN A SHIP AND A FACILITY, SUCH AS A CLIENT SHIP

(71) Applicant: GAZTRANSPORT ET TECHNIGAZ, Saint Remy les Chevreuse (FR)

(72) Inventors: Guillaume Gelin, Orsay (FR); Patrick Englebert, Asse Mollem (BE)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 14 days.

(21) Appl. No.: 15/126,498

(22) PCT Filed: Mar. 16, 2015

(86) PCT No.: PCT/FR2015/050628
§ 371 (c)(1),
(2) Date: Sep. 15, 2016

(87) PCT Pub. No.: WO2015/145020
PCT Pub. Date: Oct. 1, 2015

(65) Prior Publication Data

US 2017/0096195 A1 Apr. 6, 2017

(30) Foreign Application Priority Data

Mar. 24, 2014 (FR) ..... 14 52471

(51) Int. Cl.
*B63B 27/24* (2006.01)
*B63B 27/34* (2006.01)
(Continued)

(52) U.S. Cl.
CPC ..... *B63B 27/24* (2013.01); *B63B 22/00* (2013.01); *B63B 27/34* (2013.01); *B67D 9/00* (2013.01)

(58) Field of Classification Search
CPC ..... F17C 2201/0109; F17C 2201/032; F17C 2201/052; F17C 2201/0604;
(Continued)

(56) References Cited

U.S. PATENT DOCUMENTS 4,121,616 A * 10/1978 Lochte ..... B67D 9/02 137/615
4,261,398 A * 4/1981 Haley ..... B63B 22/021 137/615
(Continued)

FOREIGN PATENT DOCUMENTS

FR 2971762 A1 8/2012
WO 0134460 A1 5/2001

*Primary Examiner* — Timothy L Maust
*Assistant Examiner* — Timothy P Kelly
(74) *Attorney, Agent, or Firm* — Notaro, Michalos & Zaccaria P.C.

(57) ABSTRACT

A system for transferring fluid between a ship and a facility has a mast with a proximal end pivotally mounted on a deck of the ship and a distal end, a fluid-transfer line extending along the mast, a flexible pipe with a first end connected to the fluid-transfer line and a second end connected to a manifold of the facility, the flexible pipe being equipped with a connecting device having an emergency cut-off comprising two elements which are capable of automatically separating in a separation direction, when a separating force which is above a threshold is exerted, and a guide element supported by the mast, and comprising a convex surface for guiding the flexible pipe which is capable of absorbing a pulling force of the flexible pipe such that this force is exerted on the connecting device having an emergency cut-off in the separation direction.

23 Claims, 10 Drawing Sheets

(51) Int. Cl.
*B67D 9/00* (2010.01)
*B63B 22/00* (2006.01)

(58) Field of Classification Search
CPC ..... F17C 2203/0604; F17C 2203/0614; F17C 2203/0619; F17C 2203/0636; F17C 2203/0639; F17C 2203/0646; F17C 2203/0665; F17C 2203/0673; F17C 2205/013; F17C 2205/0134; F17C 2205/0146; F17C 2205/0326; F17C 2205/0332; F17C 2205/0338; F17C 2205/035; B63B 27/34; B63B 27/24; B63B 22/00; B67D 9/00
See application file for complete search history.

(56) References Cited

U.S. PATENT DOCUMENTS 4,315,533 A * 2/1982 Eagles ..... B67D 9/02 137/615
4,393,906 A * 7/1983 Gill ..... B63B 22/021 137/615
4,416,306 A * 11/1983 Le Devehat ..... B67D 9/02 137/615
4,784,079 A * 11/1988 Poldervaart ..... B63B 22/025 114/230.14
6,434,948 B1 8/2002 Eide et al.
6,851,994 B2 * 2/2005 Boatman ..... B63B 27/24 114/230.15
7,066,219 B2 * 6/2006 Poldervaart ..... B63B 27/24 114/230.15
7,810,520 B2 * 10/2010 Perratone ..... B63B 21/50 137/615
8,176,938 B2 * 5/2012 Queau ..... B63B 27/24 137/342
8,490,565 B1 7/2013 Shivers, III et al.
2010/0263389 A1 * 10/2010 Bryngelson ..... F16L 37/002 62/50.2
2012/0037265 A1 * 2/2012 Bodanese ..... B65H 75/38 141/1
2017/0096195 A1 * 4/2017 Gelin ..... B63B 27/24

* cited by examiner

SYSTEM FOR TRANSFERRING FLUID BETWEEN A SHIP AND A FACILITY, SUCH AS A CLIENT SHIP

TECHNICAL FIELD

The invention relates to the field of fluid transfer and relates more particularly to the transfer of liquefied natural gas between a ship and a facility, such as a client ship.

PRIOR ART

Systems for the transfer of liquefied natural gas between two ships at sea are known in the state of the art.

Document WO0134460 discloses a system whereby liquefied natural gas can be transferred between a liquefied natural gas production vessel and a vessel transporting liquefied natural gas. The transfer system comprises three parallel flexible pipes, two of which pipes are used to transfer liquefied natural gas from the production vessel to the transport vessel while the third pipe is used to transfer gas from the transport vessel to the production vessel to balance out the pressures in the gaseous tops of the tanks on both ships and prevent the pressure within the tank on the production vessel from falling. The three flexible pipes are suspended from a mast movably mounted on the deck of the production vessel and have a free end fitted with a connecting element that acts together with a matching connecting element on the transport vessel. The connecting elements are fitted with emergency disconnection means through which they can be disconnected and the transfer of liquefied natural gas can be interrupted. The emergency disconnection means are remotely controlled from the transport vessel via a hydraulic circuit.

Such a transfer system is not entirely satisfactory. In fact, because the emergency disconnection connecting elements are particularly heavy, their location at the free end of the flexible pipes makes it particularly complex to maneuver the flexible pipes so that connection operations take a long time to perform and are not very safe. In addition to this the presence of a hydraulic circuit controlling the emergency disconnection means increases the cost and complexity of the transfer system.

In addition to this, transfer systems between a bunkering vessel and a client vessel comprising flexible pipes fitted with emergency disconnection connecting devices comprising two elements that can separate automatically when a separating force greater than a particular threshold is exerted are also known. Also such emergency disconnection connecting devices do not need hydraulic control circuits. The emergency disconnection connecting devices are located in a median portion of each flexible pipe so that they are stressed in tension along the direction in which they separate when a pulling force is exerted between the ends of the flexible pipes.

However such transfer systems too are not wholly satisfactory. In fact, to avoid risking damage to the flexible pipes as a result of excessively large flexion forces at the ends of the flexible pipes the two ends of the flexible pipes must be substantially in alignment. In addition to this emergency disconnection connecting devices can disconnect prematurely when they are subjected to pulling forces not exerted in the direction in which they separate. In practice it is only possible to align the two ends of flexible pipes for one particular position of the manifold on the client ship. Also such a transfer system cannot be adapted for a great variety of configurations of the manifold on a client vessel. Furthermore, the emergency disconnection connecting devices are handled at the time when the flexible pipes are connected to the manifold on the client ship, which risks damaging them.

SUMMARY

One idea underlying the invention is to provide a transfer system for a fluid between a ship and a facility which is simple, safe, reliable and can be adapted for a great variety of configurations.

According to one embodiment the invention provides a system for transferring a fluid between a ship and a facility comprising:

- a mast comprising a proximal end which is intended to be pivotally mounted on a deck of the ship and a distal end;
- a fluid transfer line extending along the mast;
- a flexible pipe comprising a first end connected to the fluid transfer line and a second end intended to be connected to a manifold of the facility in the course of a fluid transfer operation, the flexible pipe being provided with an emergency disconnection connecting device comprising two elements which can separate automatically in a direction of separation d when a separating force greater than a threshold is exerted; and
- a guide element carried by the mast comprising a convex guide surface for the flexible pipe which can take up the pulling force in the flexible pipe exerted between the first and second extremities of the flexible pipe when the pulling force presses the flexible pipe against the convex guide surface, the convex guide surface being arranged in relation to the emergency disconnection connecting device in such a way that when a pulling force is exerted between the first and second ends of the flexible pipe, the flexible pipe is pressed against the convex guide surface, the direction of separation d of the separable elements extends tangentially to said convex guide surface in such a way that the said pulling force is exerted on the emergency disconnection connecting device in the direction of separation d.

Thus the emergency disconnection connecting device requires no hydraulic control circuit.

In addition to this, the guide element makes it possible to ensure that when a pulling force is exerted between the ends of the flexible pipe this pulling force is substantially exerted in the direction of separation d between the two separable elements of the emergency disconnection connecting device, as a result of which the forces acting on the flexible pipe can be limited. The guide element also makes it possible to prevent premature disconnection of the emergency disconnection connecting device. The guide element also makes it possible to limit the flexural forces acting on the flexible pipe at the connection between the first end of the flexible pipe and the transfer line.

Finally, as the flexible pipe is suspended from a movable mast, the transfer system can be adapted for many different configurations.

According to some embodiments, such a transfer system may comprise one or more of the following characteristics:

- the guide element is carried on the mast at a distance from the distal extremity of the mast, the system comprising a saddle suspended at the distal extremity of the mast comprising an upper convex surface supporting the flexible pipe.
- the saddle is suspended at the distal extremity of the mast by means of a lifting device. Thus the free end of the flexible pipe can be easily led to the manifold of the facility without placing any mechanical stress on the flexible pipe.

the distance between the guide element and the distal extremity of the mast is such that when the mast is located in an extreme raised position the flexible conduit forms a loop between the guide element and the saddle, the radius of curvature of which is greater than or equal to a minimum permissible radius of curvature for the flexible pipe.

the guide element has a radius of curvature greater than or equal to a minimum permissible radius of curvature for the flexible pipe.

in the connection zone between the flexible pipe and the fluid transfer line, the fluid transfer line is orientated in the direction of the end of the transfer line having a longitudinal component in relation to the axis of the mast directed toward one of the distal or proximal extremities of the mast; the convex guide surface being directed toward said distal or proximal extremity of the mast to which the longitudinal component of the direction in which the end of the fluid transfer line is directed.

the direction of the end of the fluid transfer line lies tangentially to the convex guide surface.

the emergency disconnection connecting device is located at the first end of the flexible pipe to connect the flexible pipe and the fluid transfer line.

the flexible pipe comprises a first flexible portion extending between its first end and the emergency disconnection connecting device and a second flexible portion extending between the emergency disconnection connecting device and its second end.

the second flexible portion of the flexible pipe is associated with a buoy. Advantageously the buoy is attached to the second flexible portion close to the emergency disconnection connecting device.

the system comprises a plurality of fluid transfer lines extending along the mast and a plurality of flexible pipes each comprising a first end connected to the fluid transfer line, a second end that is intended to be connected to a manifold of the facility and an emergency disconnection connecting device comprising two elements which can separate automatically in a direction of separation d when a separating force greater than a threshold is exerted, the convex guide surface being arranged in relation to the emergency disconnection connecting devices in such a way that when the pulling forces acting between the first and second ends of the flexible pipes press the flexible pipes against the convex guide surface the directions of separation d of the separable elements extend tangentially to said convex guide surface so that the forces act on the emergency disconnection connecting devices in direction of separation d.

the convex guide surface comprises, for each flexible pipe, a guide groove, each of the guide grooves being edged with separating walls.

the guide element is in the shape of a portion of a hollow bell comprising a summit fitted with an opening for passage of the flexible pipes.

the convex guide surface of the guide element is covered with a non-stick coating.

the convex guide surface is fitted with a plurality of rollers mounted so as to rotate.

the system comprises a braking device for controlling the rate at which the flexible pipe falls during an emergency disconnection, the braking device comprising:

a drum;

a cable partly wound round the drum and partly attached to one of the separable elements of the emergency disconnection connecting device;

a shaft associated with the drum which can move in rotation in such a way that rotation of the drum in a direction in which the cable is unwound causes the shaft to rotate;

a metering pump fitted with a rotor rotationally coupled with the shaft; and a closed-loop hydraulic circuit associated with the metering pump, fitted with a flow regulator.

the system comprises a plurality of fluid transfer lines extending along the mast and a plurality of flexible pipes each comprising a first end connected to the fluid transfer line, a second end intended to be connected to a manifold of the facility and an emergency disconnection connecting device comprising two elements which can separate automatically; for each flexible pipe the braking device comprises a drum and a cable wound around said drum and firmly attached to one of the separable elements of the emergency disconnection connecting device of said flexible pipe; each pipe being associated with the shaft by means of a device having a wheel free to move in one direction or non-return wheel so that rotation of the drum in a direction in which the cable is unwound causes the shaft to rotate in a first direction of rotation and the shaft can turn freely in a first direction of rotation without causing the drum to rotate in the direction in which the cable is unwound.

one end of the cable is attached to a pin, the drum having a groove to house said pin.

the system also comprises a device for detecting emergency disconnection which can detect rotation of the drum of the braking device and produce a detection signal when rotation of the drum is detected.

the emergency disconnection detection device is arranged to provide an alarm signal and/or a stop signal to a pump intended to ensure transfer of fluid between the ship and the facility through the fluid transfer line and the flexible pipe.

the emergency disconnection detection device comprises one or more movement sensors which are each associated with a drum. The movement sensor(s) is/are selected from movement sensors such as roller sensors, linear displacement sensors, contact-free sensors, such as magnetic sensors, and optical fiber sensors.

According to one embodiment the invention also provides a ship equipped with a transfer system as mentioned above.

According to one embodiment the invention also provides a process for the transfer of a fluid in which, during the course of the transfer operation, the mast is positioned such that when a pulling force is exerted between the first end and the second end of the flexible pipe said flexible pipe is pressed against the convex guide surface.

In one embodiment the process comprises an operation of draining the flexible pipe during which the mast is moved to a position in which the flexible pipe occupies a descending slope from the mast toward the ship's manifold in such a way as to allow fluid present within the flexible pipe to flow by gravity.

According to one embodiment the invention also provides a braking device to control the rate of fall of a plurality of flexible pipes equipped with an emergency disconnection connecting device, the braking device comprising for each flexible pipe a drum and a cable partly wound around the drum and partly attached to one of the separable elements of the emergency disconnection connecting device; the braking device comprising a movable shaft, a metering pump equipped with a rotor coupled to the shaft in rotation, and a closed-loop hydraulic circuit associated with the metering pump fitted with a flow regulator, each drum being associated with the shaft by means of a device having a wheel that is free to move in one direction or a non-return wheel such that rotation of the drum in the direction in which the cable is unwound causes the shaft to rotate in a first direction of rotation and the shaft can turn freely in the first direction of rotation without causing the drum to rotate in the direction in which the cable is unwound.

It should be noted that such a braking device can also be applied to transfer systems other than the transfer system which will be described below. In general, such a braking device may find applications in all transfer systems comprising a plurality of flexible pipes fitted with an emergency disconnection connecting device and whose fall has to be braked when undergoing emergency disconnection.

BRIEF DESCRIPTION OF THE FIGURES

The invention will be better understood, and other aims, details, characteristics and advantages thereof will be more clearly apparent in the course of the following description of several particular embodiments of the invention that are provided purely by way of illustration and without limitation, with reference to the appended drawings.

DETAILED DESCRIPTION OF EMBODIMENTS

Figure 1:
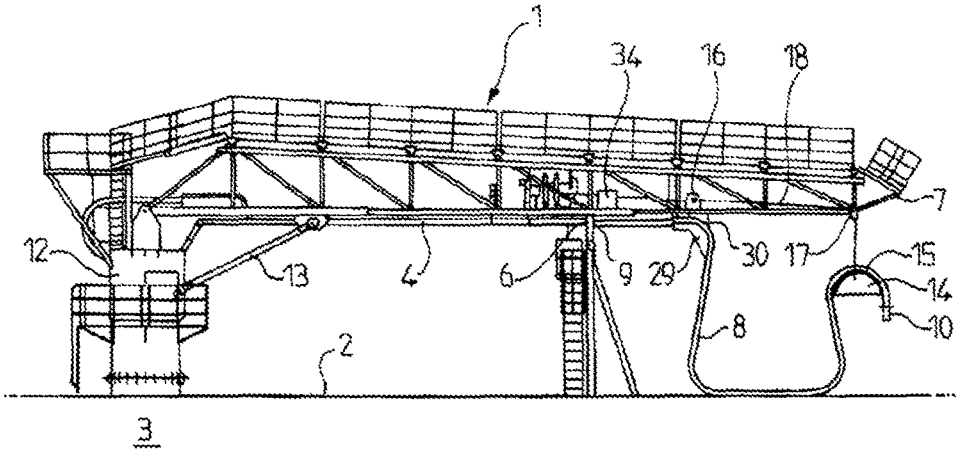
FIGS. 1 to 5 are views of a fluid transfer system illustrating the stages in maneuvering the transfer system to connect a ship to a facility.

A transfer system that can be used to transfer a fluid such as liquefied natural gas (LNG) between a supply ship and a facility, such as a client ship, will be described below. The supply ship is for example a bunkering ship responsible for refueling other ships with LNG, and the client ship is a ship propelled by LNG.

With reference to FIGS. 1 to 6, it will be seen that the transfer system comprises a lattice mast 1 mounted on the deck 2 of supply ship 3. Lattice mast 1 comprises three uprights assembled by a plurality of bracing cross-members extending between the uprights.

Mast 1 carries a plurality of transfer lines 4 extending along the mast. Transfer lines 4 comprise rigid elements. For example, mast 1 carries three transfer lines 4. Two of transfer lines 4 are connected to a liquefied natural gas storage tank on supply ship 3 and are used to transfer liquefied natural gas from supply ship 3 to the client ship. Third transfer line 4 allows natural gas in the gaseous state to be extracted from client ship 5 toward supply ship 3. This third transfer line 4 may be connected to a natural gas reliquefaction plant embarked on supply ship 3. Pumps mounted on supply ship 3 and/or pumps mounted on client ship 5 are advantageously used to produce the pressure necessary for the transfer of liquefied natural gas.

Transfer lines 4 have a distal end 6 extending at a distance from a distal extremity 7 of mast 1. Each of the distal ends 6 of transfer lines 4 is connected to a flexible pipe 8. Flexible pipes 8 therefore comprise a first end 9 connected to transfer line 4 and a second free end 10 intended to be connected to a manifold 11 on client ship 5 so that fluid can be transferred between supply ship 3 and client ship 4.

Flexible pipes 8 advantageously comprise cryogenic pipes, such as composite pipes or double-walled pipes, of stainless steel, in which the intermediate space is packed with an insulating material. In one embodiment the insulating material is placed under negative pressure to improve its insulation properties.

Mast 1 is mounted with articulation on deck 2 of supply ship 3. In order to achieve this mast 1 is mounted so as to pivot about a horizontal axis between a retracted position illustrated in FIG. 1 and an extreme raised position illustrated in FIG. 4. In its extreme raised position mast 1 is here inclined at an angle of approximately 60° with respect to deck 2 of supply ship 3. Mast 1 is also mounted so that it can move in rotation about a vertical axis. In order to achieve this mast 1 is mounted on a base 12 which can rotate about a vertical axis. So that mast 1 can be moved between its retracted position and its extreme raised position the transfer system is fitted with a set of actuating jacks 13, each of which has one end mounted with articulation on the uprights of mast 1 and a second end mounted with articulation on base 12.

The transfer system comprises a saddle 14 supporting flexible pipes 8 suspended from the distal extremity 7 of mast 1. Saddle 14 has an upper convex surface 15 supporting flexible pipes 8. Upper convex surface 15 is an arched surface whose radius of curvature is greater than or equal to the minimum permissible radius of curvature for flexible pipes 8. The minimum permissible radius of curvature corresponds to the minimum value of the radius to which flexible pipes 8 can be bent without damage or without reducing their service lives. This value is generally specified by the manufacturers of flexible pipes. By way of example, the minimum permissible radius of curvature is of the order of 700 mm in the case of cryogenic pipes having an outside diameter of the order of 170 mm, and of the order of 500 mm for such cryogenic pipes having an outside diameter of the order of 100 mm.

Saddle 14 is suspended from distal extremity 7 of mast 1 by means of a lifting device. The lifting device is a cable lifting device. The lifting device comprises a drum 16 which can be driven in rotation by a motor, a return pulley 17 located at distal extremity 7 of mast 1, and a cable 18 acting together with return pulley 17 which is partly wound around drum 16 and partly attached to saddle 14.

Figure 6:
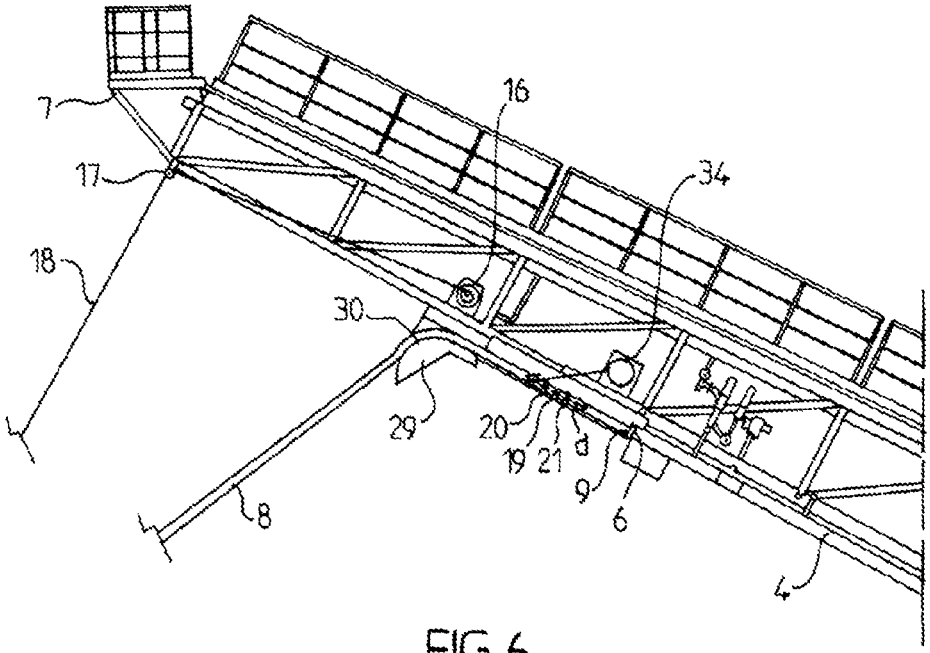
FIG. 6 is a detailed view of the extremity of the mast of the transfer system in FIGS. 1 to 5.
Figure 7A:
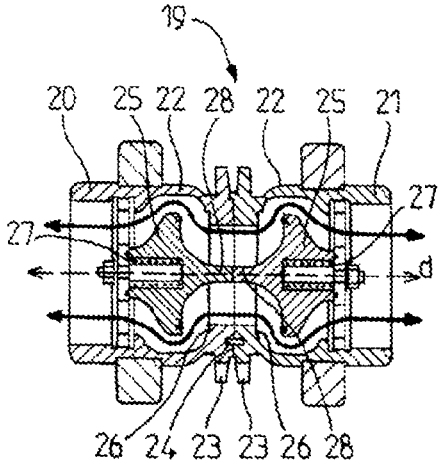
FIGS. 7*a* and 7*b* illustrate an emergency disconnection connecting device in a connected condition and in a disconnected condition respectively.
Figure 7B:
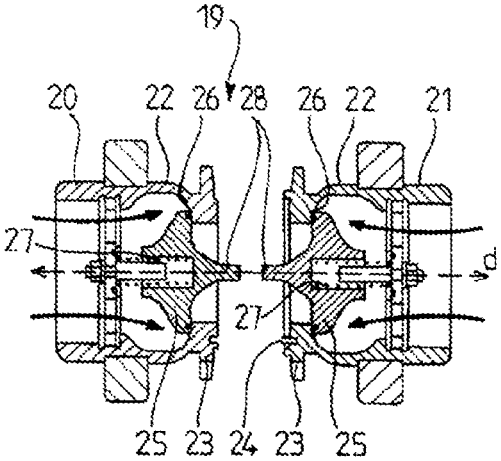

With reference to FIG. 6, it will be seen that flexible pipes 8 have an emergency disconnection connecting device 19 close to their first ends 9. By way of example, such an emergency disconnection connecting device 19 is illustrated in detail in a connected condition in FIG. 7*a*, and in a disconnected condition in FIG. 7*b*.

Emergency disconnection connecting device 19 comprises two separable elements 20, 21. The two elements 20, 21 can separate in a direction of separation d when a separation force greater than a threshold is exerted. In the embodiment illustrated the two elements 20, 21 each have a hollow cylindrical body 22 through which fluid can circulate. The two elements 20, 21 each have an attachment flange 23 providing a leaktight connection to attachment flange 23 of the other element. Attachment flanges 23 are attached to each other by means of an attachment member 24 that is designed to break when a separation force greater than a specific threshold is exerted on emergency disconnection connecting device 19.

Each of separable elements 20, 21 is fitted with a non-return valve 25 which can prevent the passage of fluid should elements 20, 21 separate. In the embodiment illustrated, non-return valve 25 is mounted so as to move within hollow cylindrical body 22 between an open position illustrated in FIG. 7*a*, in which non-return valve 25 allows fluid to pass through emergency disconnection connecting device 19, and a closed position, illustrated in FIG. 7*b*, in which non-return valve 25 forms a leaktight contact against a shoulder 26 of hollow cylindrical body 22 to prevent the passage of fluid. Non-return valves 25 are each returned to their closed positions by means of a spring 27. In addition to this, non-return valves 25 incorporate disk members 28 acting against each other when the two elements 20, 21 of emergency disconnection connecting device 19 are connected in such a way as to compress springs 27 and hold non-return valves 25 in an open position.

In one embodiment, which is not illustrated, the non-return valves are mounted so as to pivot between their open positions and their closed positions.

Returning to FIG. 6, it will be seen that the transfer system is also equipped with a guide element 29 whereby flexible pipes 8 can be guided in such a way that when a pulling force is exerted on flexible pipes 8 between their first ends 9 and their second ends 10, this force acts on emergency disconnection connecting device 19 in the direction d in which separable elements 20, 21 separate. In the embodiment illustrated it will be seen that a portion of flexible pipe 8 extends between emergency disconnection connecting device 19 and end 6 of the transfer line. Through such an arrangement the direction of separation d of emergency disconnection connecting device 19 is ideally positioned when a pulling force is exerted on flexible pipe 8.

Guide element 29 comprises a convex guide surface 30. Convex guide surface 30 is of an arched shape having a radius of curvature greater than or equal to the minimum permissible radius of curvature of flexible pipes 8.

When a pulling force is exerted between first end 9 and second end 10 of flexible pipes 8, flexible pipes 8 are pressed against guide surface 29 which then takes up the pulling force. The portion of flexible pipes 8 extending between end 6 of transfer line 4 and guide element 28 is then placed under tension so that direction of separation d extends tangentially to convex guide surface 30. Thus the pulling force is exerted on emergency disconnection connecting device 19 in direction of separation d.

In order to limit the flexural stresses acting on the flexible pipes at the connection between first end 9 of flexible pipes 8 and transfer lines 8, convex guide surface 30 is directed toward distal extremity 7 of mast 1 when end 6 of the transfer line is orientated toward distal extremity 7 of mast 1. Conversely, as we will see below in relation to other embodiments, the convexity of convex guide surface 30 is conveniently orientated toward the proximal extremity of mast 1 when end 6 of transfer line 4 is generally directed toward the proximal extremity of mast 1. Furthermore it is also advantageous that end 6 of transfer line 4 should also be orientated tangentially to convex guide surface 30.

Figure 8:
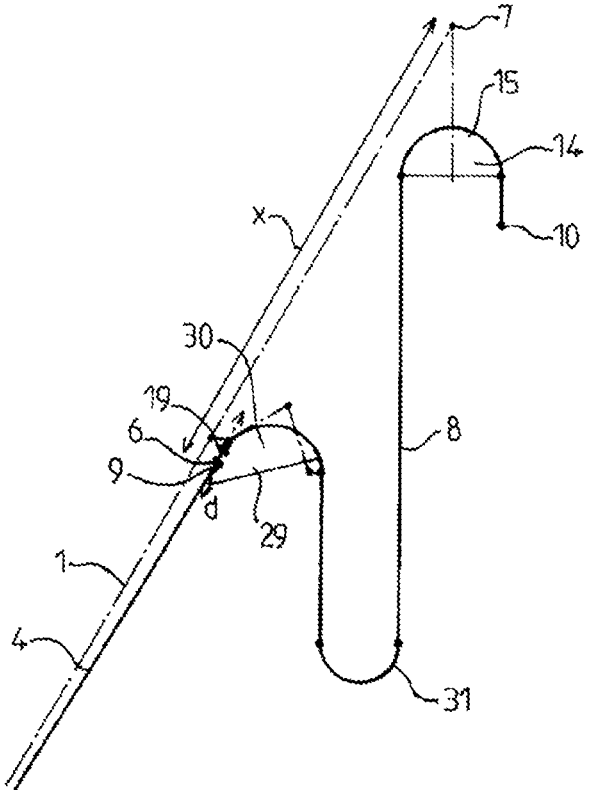
FIG. 8 provides a diagrammatical illustration of the support and guide for a flexible pipe of a transfer system according to one embodiment of the invention.

Furthermore, as illustrated in FIG. 8, distance x between guide element 29 and distal extremity 7 of mast 1 from which saddle 14 is suspended is determined so that when mast 1 is located in its extreme raised position flexible pipes 8 form a loop 31 whose radius of curvature is greater than or equal to the minimum permissible radius of curvature for flexible pipes 8.

FIGS. 1 to 5 illustrate a succession of stages in maneuvering the transfer system during a fluid transfer operation between a supply ship 3 and a client ship 5.

Figure 2:
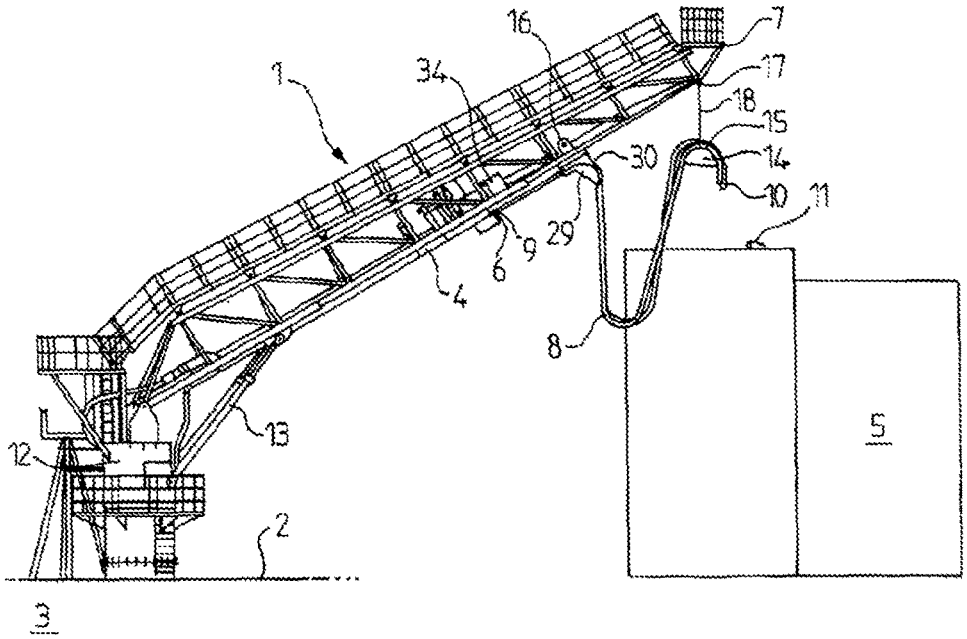
Figure 3:
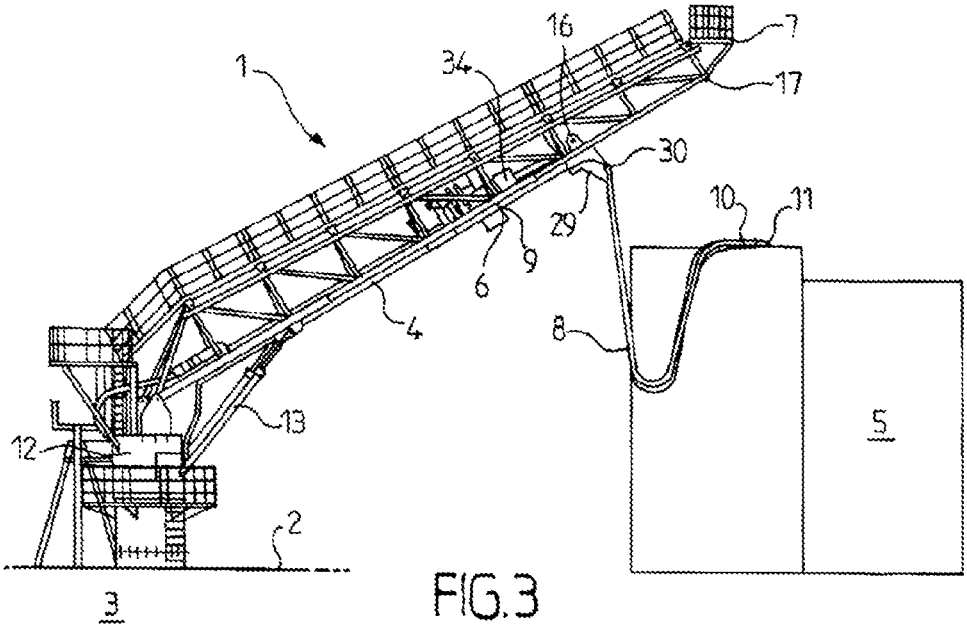

In a retracted position, illustrated in FIG. 1, mast 1 extends substantially horizontally. When supply ship 3 and client ship 5 are moored together, mast 1 is moved so that its distal extremity 7 is positioned close to manifold 11 on client ship 5, as illustrated in FIG. 2. The device lifting saddle 14 is then controlled so as to deposit saddle 14 on the deck of client ship 5. Flexible pipes 8 are then connected to manifolds 11 of client ship 5 so that liquefied natural gas can be transferred between supply ship 3 and client ship 5, as illustrated in FIG. 3.

Figure 4:
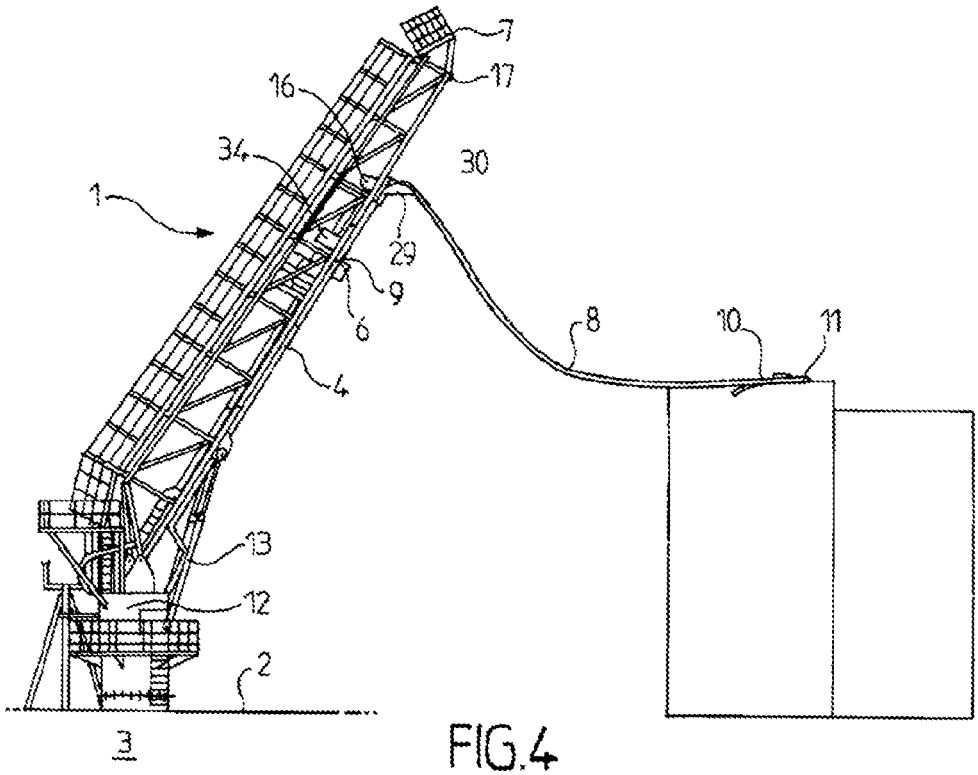
Figure 5:
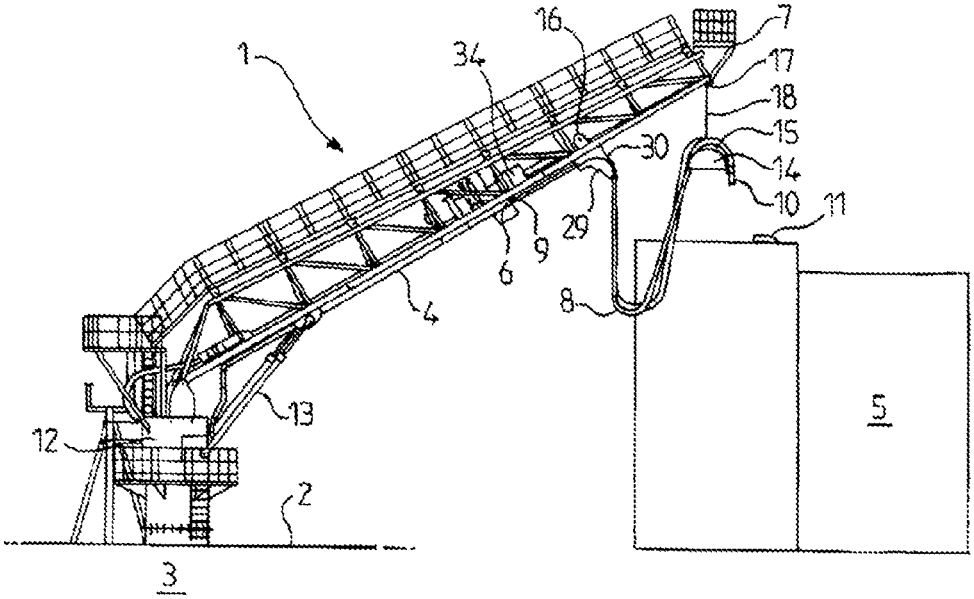

Once the transfer of liquefied natural gas has ended, mast 1 is moved into a draining position, illustrated in FIG. 4, in which flexible pipes 8 adopt a descending slope from mast 1 toward the deck of client ship 4 so that liquefied natural gas present in flexible pipes 8 can flow by gravity toward manifolds 11 of client ship 5. Flexible pipes 8 are then disconnected from manifolds 11 of client ship 5 and then saddle 14 can be raised using the lifting device, as illustrated in FIG. 5, to raise ends 10 of flexible pipes 8. Mast 1 is then returned to its retracted position illustrated in FIG. 1.

FIGS. 9 to 13 diagrammatically illustrate arrangements of guide element 29 and emergency disconnection connecting device 19 according to several embodiments. In these figures the resting position of flexible pipe 8 is illustrated in solid lines, while the position of flexible pipe 8 when a pulling force is exerted is represented by dashed lines.

Figure 9:
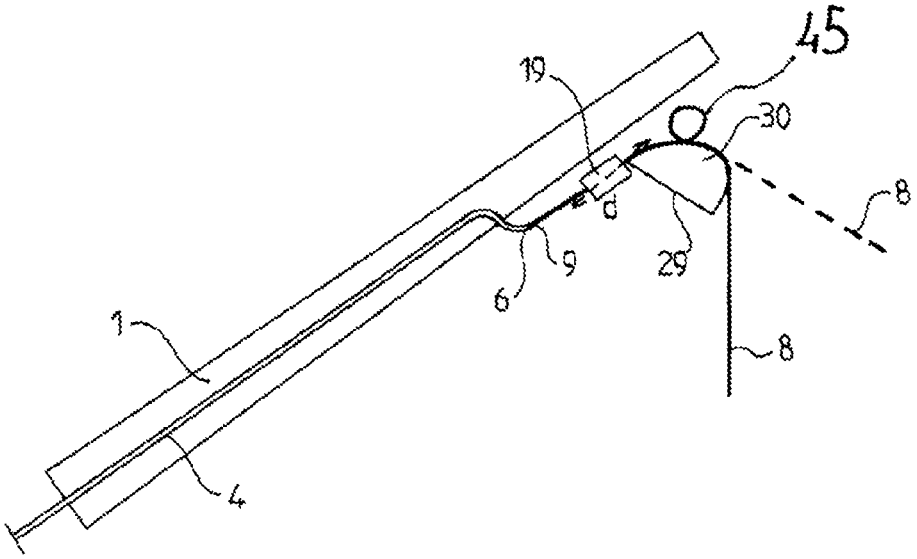
FIGS. 9 to 13 are diagrammatical views of transfer systems according to five different embodiments, which illustrate, as a solid line, the resting position of a flexible pipe and, as dashed lines, the position of the flexible pipe when a pulling force exerted between the first and second ends of the flexible pipe presses the flexible pipe against the guide element.

FIG. 9 is a diagrammatical representation of the embodiment in FIGS. 1 to 6.

Figure 10:
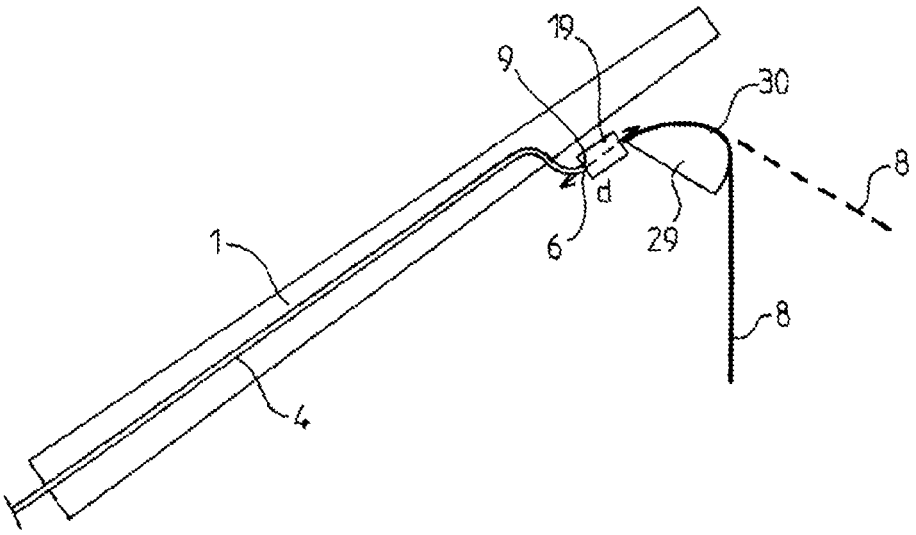

The embodiment in FIG. 10 differs from that in FIG. 9 in that emergency disconnection connecting device 19 is located at first end 9 of flexible pipe 8, that is to say at the junction between transfer line 4 and flexible pipe 8, to ensure that they operate axially. Emergency disconnection connecting device 19 is therefore fixed with respect to mast 1. End guide member 29 is attached to mast 1 in a position such that the direction d in which emergency disconnection connecting device 19 separates extends substantially tangentially to convex guide surface 30.

Figure 11:
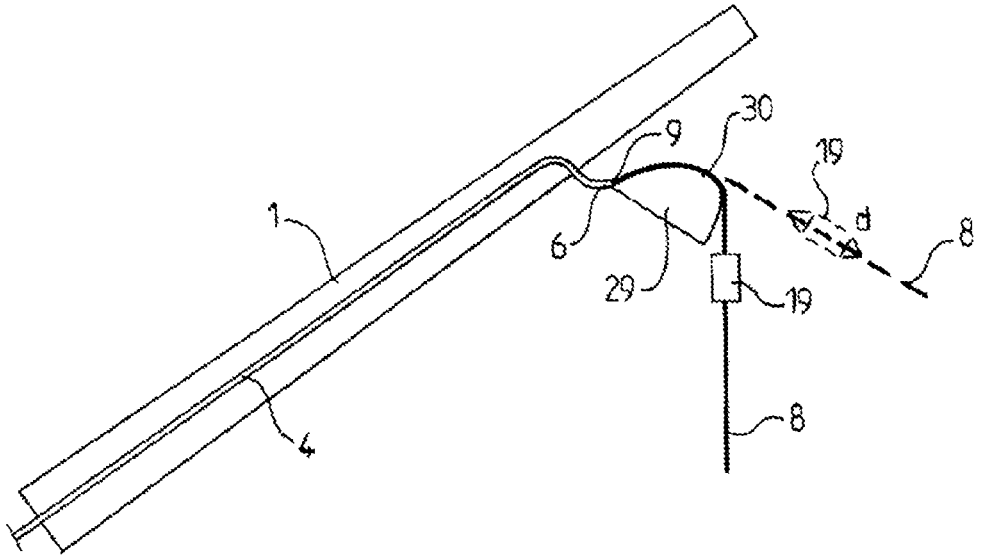

The embodiment in FIG. 11 differs from that in FIG. 9 in that emergency disconnection connecting device 19 is located at a portion of flexible pipe 8 extending between guide member 29 and second end 10 of flexible pipe 8.

Figure 12:
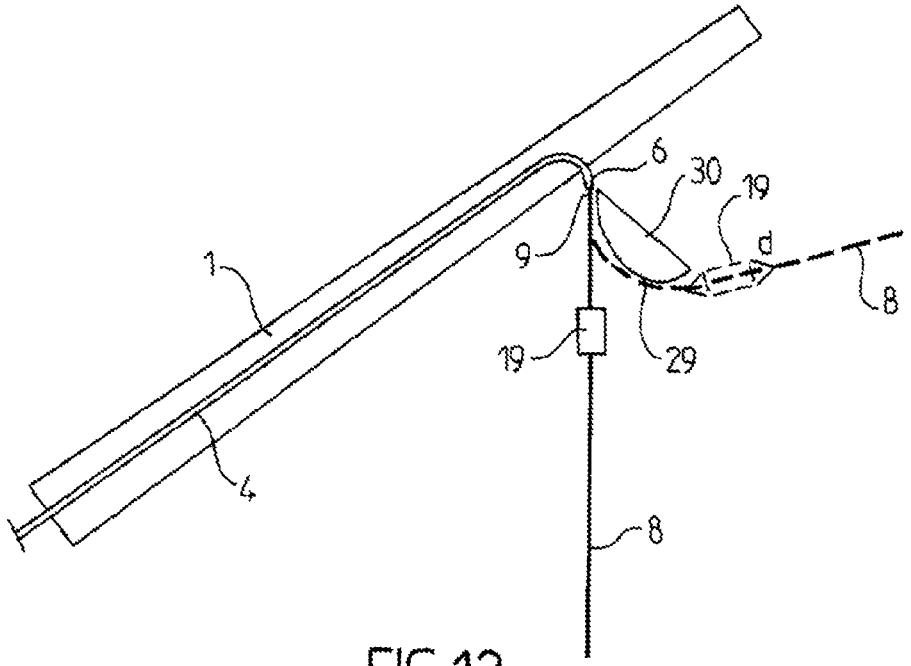
Figure 13:
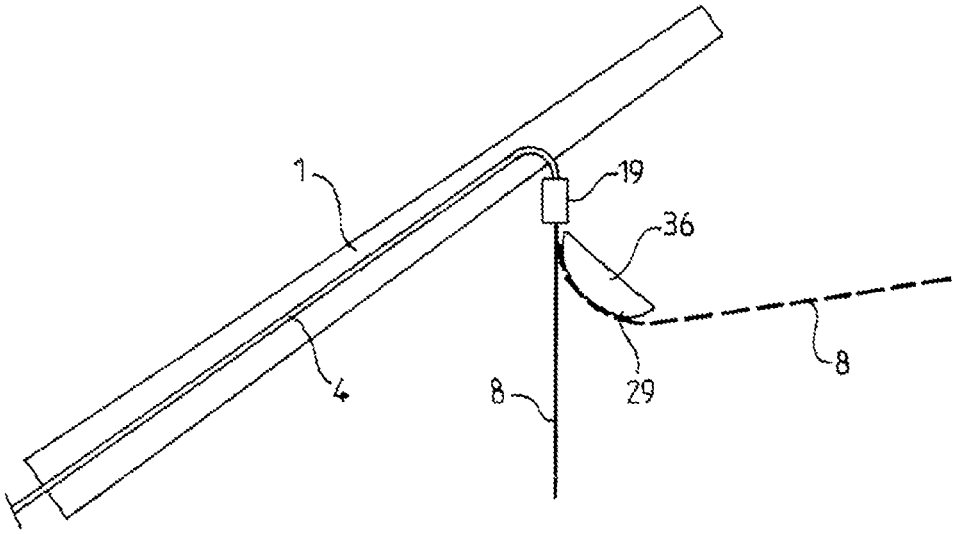

In the embodiments in FIGS. 12 and 13 the convexity of convex guide surface 30 is directed toward the proximal extremity of mast 1 because end 6 of the transfer line has a longitudinal component orientated toward proximal extremity 7 of mast 1.

As illustrated in FIG. 9, each flexible pipe 8 can be provided with a buoy 45 to aid recovery of flexible pipe 8 in the event of emergency disconnection. In order to achieve this buoy 45 is associated with the portion of flexible pipe 8 which is intended to fall into the sea in the event of an emergency disconnection, that is to say the portion of flexible pipe 8 extending between emergency disconnection connecting device 19 and second end 10 of flexible pipe 8. Preferably buoy 45 is attached to flexible pipe 8 close to emergency disconnection connecting device 19.

Figure 14:
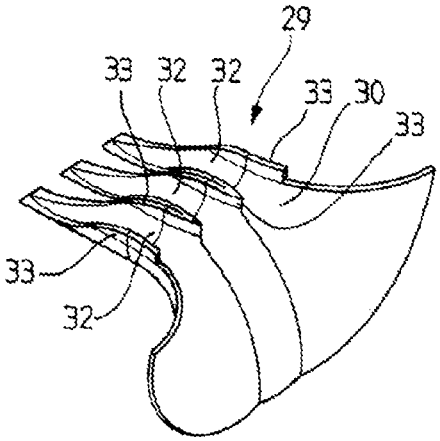
FIG. 14 illustrates a guide element for flexible pipes according to one embodiment.
Figure 15:
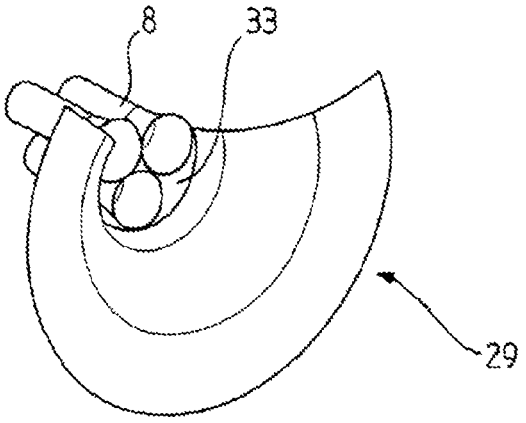
FIG. 15 illustrates a guide element for flexible pipes according to another embodiment.

FIGS. 14 and 15 illustrate guide members according to two alternative embodiments. In the embodiment illustrated in FIG. 14 the guide member comprises a guide groove 32 for each flexible pipe 8. Each of grooves 32 is edged by walls 33 which project to a greater or lesser extent to ensure that flexible pipes 8 are guided laterally. In the embodiment illustrated in FIG. 15, guide member 29 is in the shape of a hollow portion of a bell having a summit provided with an opening 33 for passage of the flexible pipes.

According to one embodiment convex guide surface 30 is covered with a non-stick coating to reduce friction forces between convex guide surface 30 and flexible pipes 8. The non-stick coating is for example of polytetrafluoroethylene (PTFE). According to another embodiment, not shown, guide surface 30 is fitted with a plurality of rollers mounted so as to rotate and thus reduce the friction forces acting between convex guide surface 30 and flexible pipes 8.

Figure 16:
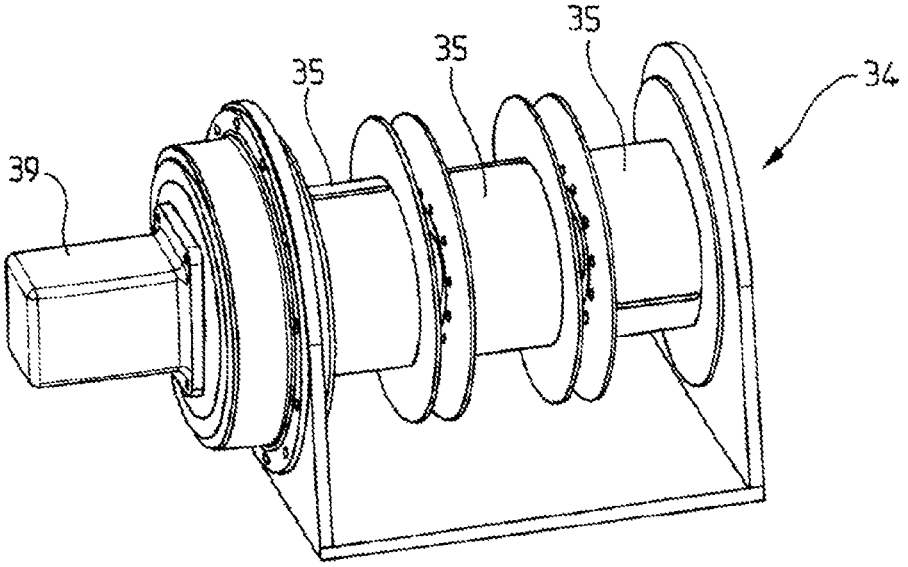
FIG. 16 is a perspective view of a braking device for controlling the rate of fall of flexible pipes during emergency disconnection.
Figure 17:
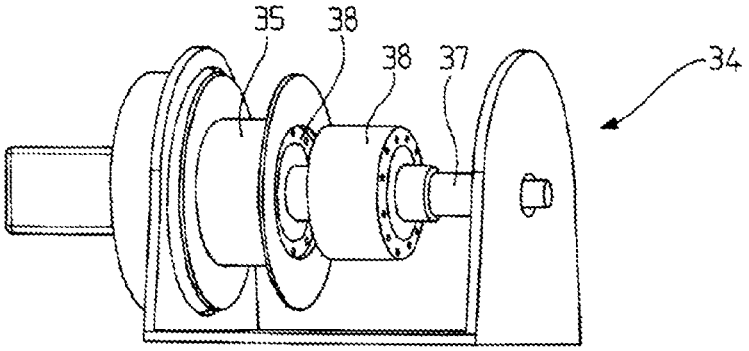
FIG. 17 is a perspective view partly illustrating the braking device in FIG. 16.
Figure 19:
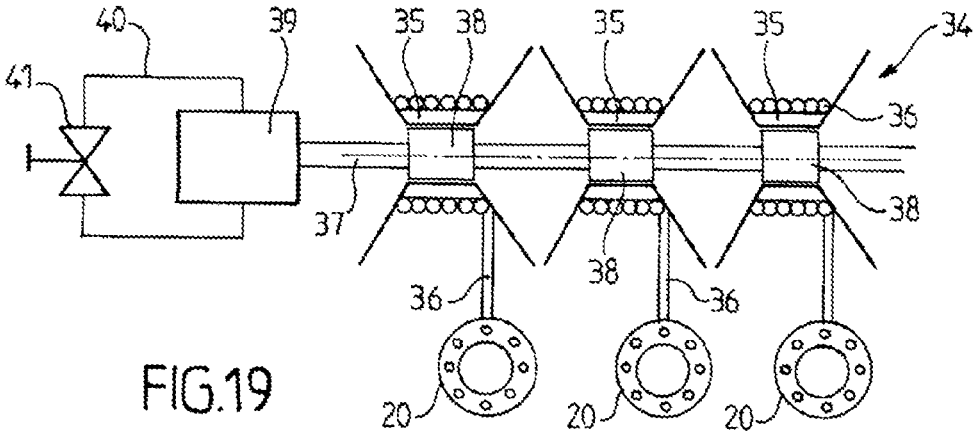
FIG. 19 is a diagrammatical view in cross section of the braking device in FIGS. 16 and 17.

In addition to this, the transfer system is equipped with a braking device 34 to control the rate at which flexible pipes 8 fall in the event of emergency disconnection, illustrated in detail in FIGS. 16, 17 and 19. For each flexible pipe 8 braking device 34 comprises a drum 35 and a cable 36 partly wound around its respective drum 35 and partly connected to element 20 of emergency disconnection connecting device 20 connected to flexible pipe 8 or the portion of flexible pipe 8 which might fall during emergency disconnection. Drums 35 are each mounted on a shaft 37 by means of a device free to move in one direction or non-return device 38.

Thus rotation of drum 35 in a direction in which the cable is unwound causes the shaft to rotate in a first direction of rotation, whereas conversely the shaft can turn freely in this first direction of rotation without causing the drum to rotate in the direction in which the cable is unwound. Cables 36 of each of drums 35 can thus be unwound independently.

Furthermore, shaft 37 is associated with a speed control unit which can be used to control the rate at which the flexible pipe falls. The speed control unit comprises a metering pump 39 fitted with a rotor coupled in rotation to shaft 37. Metering pump 39 is associated with a closed loop hydraulic circuit 40 fitted with a flow regulator 41, such as a constant flow valve. Thus the speed of rotation of shaft 37 and thus the rate of fall of flexible pipes 8 can be controlled, in that metering pump 39 provides a flow proportional to its rotation speed and the flow regulator also controls the flow from the pump.

Figure 18:
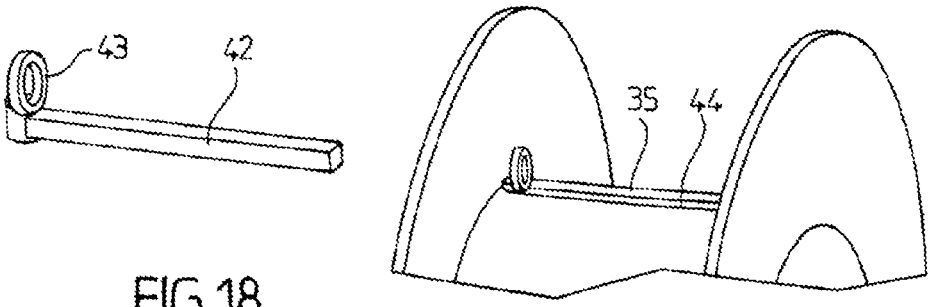
FIG. 18 illustrates a drum of the braking device in FIGS. 16 and 17 provided with a pin that allows the cable to be released.

In one embodiment braking device 34 is arranged so as to allow cables 36 to be released when these are fully unwound from their drum 35. In order to do this, as illustrated in FIG. 18, one end of the cable is attached to a pin 42 provided with an eye 43 which allows cable 36 to be inserted and secured. Drum 35 comprises a groove 44 made in the cylindrical surface of drum 35, extending along a generatrix of the cylindrical surface of drum 35. Groove 44 is arranged so as to receive pin 42. Thus pin 42 can only disengage from drum 35 once cable 36 is fully unwound.

Figure 20:
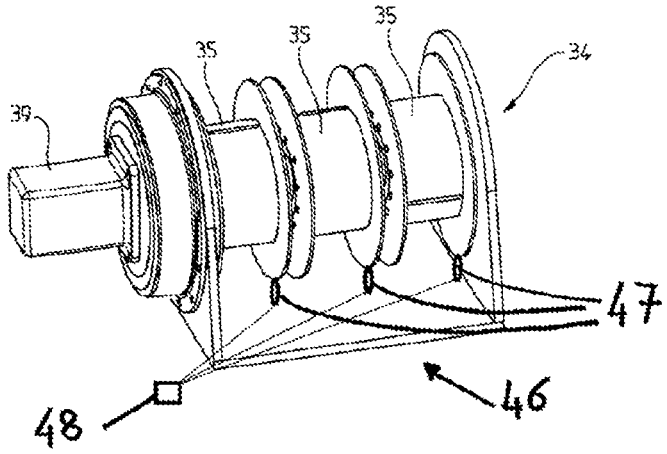
FIG. 20 illustrates a braking device associated with an emergency disconnection detection device according to a first embodiment.

In FIG. 20 an emergency disconnection detection device 46 according to a first embodiment is associated with braking device 4. Detection device 46 comprises a plurality of movement sensors 47 each fitted with a roller acting together with one of drums 35 to allow rotational movement of the drums to be detected. Movement sensors 47 are connected to a processing unit 48. Processing unit 48 can process signals produced by movement sensors 47 and generate a detection system when at least one of movement sensors 47 produces a signal representative of rotation of associated drum 35. Processing unit 47 can in particular produce an alarm signal warning the crew of an emergency disconnection and/or produce a signal that stops the pumps from transferring liquefied natural gas from the supply ship to the client ship and vice versa. Thus stopping the pumps in the event of an emergency disconnection prevents excess pressure from being produced in transfer line 4 and the first portion of flexible pipe 8—that is to say in the portion between the end of the flexible pipe connected to transfer line 4 and the emergency disconnection connecting device—when fluid is transferred from the supply ship to the client ship; and in the second portion of flexible pipe 8—that is to say in the portion extending between the end of the flexible pipe connected to the manifold on the client ship and the emergency disconnection connecting device—when fluid is transferred from the client ship to the supply ship.

Figure 21:
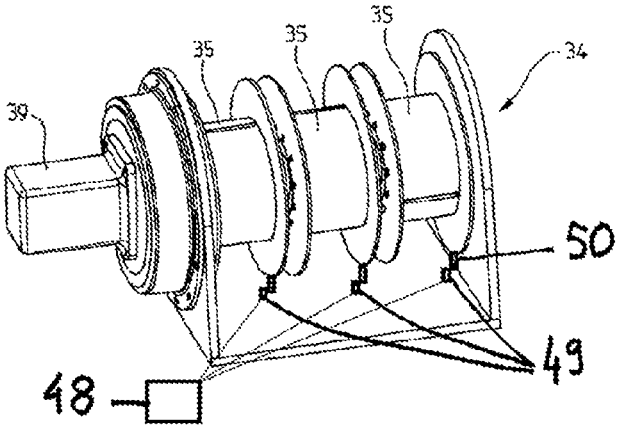
FIG. 21 illustrates a braking device associated with an emergency disconnection detection device according to a second embodiment.

The embodiment illustrated in FIG. 21 differs from that in FIG. 19, in that movement sensors 49 are linear displacement sensors or sensors which are each capable of acting together with a contact piece 50 carried on one of drums 35 in such a way that rotational movement of a drum gives rise to linear displacement of movement sensor 49.

Alternatively movement sensors 47 may also be contact-free sensors, such as magnetic sensors.

Figure 22:
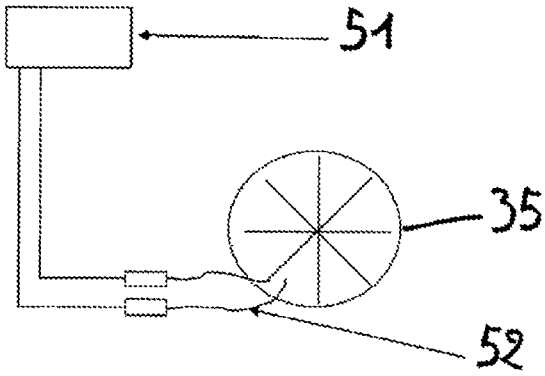
FIG. 22 illustrates an emergency disconnection detection device according to a third embodiment.

Finally, in the embodiment illustrated in FIG. 22, movement sensors 51 are optical fiber sensors comprising an emitter, a receiver and an optical fiber. According to one embodiment, movement sensors 51 comprise an optical fiber 52 of which one end is attached to drum 35 and is therefore arranged so that it will break when drum 35 rotates, so that the sensor will detect rotation of drum 35.

Although the invention has been described in connection with several particular embodiments it is obvious that it is not thereby limited in any way and that it comprises all technical equivalents of the means described, together with their combinations if these fall within the scope of the invention.

Use of the words "comprise" or "include" and their conjugated forms do not rule out the presence of other elements or stages other than those described in the claims. Use of the indefinite article "an" for an element or stage does not unless mentioned otherwise rule out the presence of a plurality of such elements or stages.

In the claims, references between brackets are not to be interpreted as being a limitation on the claim.

The invention claimed is:

1. A system for transferring a fluid between a ship and a facility, the system comprising:

a mast comprising a proximal extremity intended to be pivotally mounted on a deck of the ship and a distal extremity;

a fluid transfer line extending along the mast;

a flexible pipe comprising a first extremity connected to a fluid transfer line and a second extremity intended to be connected to a manifold of the facility during a fluid transfer operation, the flexible pipe being fitted with an emergency disconnection connecting device comprising two elements capable of separating automatically in a direction of separation d when a separating force greater than a threshold is exerted, the direction of separation d extending along a length direction of the flexible pipe, the two elements being attached to each other by means of an attachment member that is designed to break when a separation force greater than the threshold is exerted; and a guide element, carried by the mast, comprising a convex guide surface for the flexible pipe which is arranged so that the flexible pipe is pressed against the said convex guide surface when a pulling force is exerted between the first and second ends of the flexible pipe and which is capable of taking up a pulling force on the flexible pipe exerted between the first and second ends of the flexible pipe when the pulling force presses the flexible pipe against the convex guide surface, the convex guide surface being arranged in relation to the emergency disconnection connecting device in such away that when a pulling force exerted between the first and second ends of the flexible pipe presses, the flexible pipe is against the convex guide surface, the direction of separation d in which the separable elements separate extends tangentially to the said convex guide surface in such a way that the said pulling force is exerted on the emergency disconnection connecting device in the direction of separation d.

2. The system as claimed in claim 1, wherein the guide element is carried by the mast at a distance from the distal extremity of the mast, the system comprising a saddle suspended from the distal extremity of the mast and comprising a convex upper surface supporting the flexible pipe.

3. The system as claimed in claim 2, wherein the saddle is suspended from the distal extremity of the mast by means of a lifting device.

4. The system as claimed in claim 2, wherein the distance between the guide element and the distal extremity of the mast is such that when the mast is located in an extreme raised position the flexible pipe forms a loop between the guide element and the saddle, the radius of curvature of which is greater than or equal to a minimum permissible radius of curvature for the flexible pipe.

5. The system as claimed in claim 1, wherein the guide element has a radius of curvature greater than or equal to a minimum permissible radius of curvature for the flexible pipe.

6. The system as claimed in claim 1, wherein, in a connection zone between the flexible pipe and the fluid transfer line, the fluid transfer line is orientated, in relation to an end direction of the fluid transfer line having a longitudinal component in relation to the axis of the mast, directed toward one of the distal or proximal extremities of the mast and wherein the convex guide surface has a convexity of which is directed toward said distal or proximal extremity of the mast toward which the longitudinal component of the end direction of the fluid transfer line is directed.

7. The system as claimed in claim 6, wherein the direction of the end of the fluid transfer line is orientated tangentially to the convex guide surface.

8. The system as claimed in claim 1, wherein the emergency disconnection connecting device is located at the first end of the flexible pipe to connect the flexible pipe and the fluid transfer line.

9. The system as claimed in claim 1, wherein the flexible pipe comprises a first flexible portion extending between its first end and the emergency disconnection connecting device and a second flexible portion extending between the emergency disconnection connecting device and its second end.

10. The system as claimed in claim 8, wherein the second flexible portion of the flexible pipe is associated with a buoy.

11. The system as claimed in claim 1, comprising a plurality of fluid transfer lines extending along the mast and a plurality of flexible pipes each comprising a first end connected to the fluid transfer line, a second end intended to be connected to a manifold of the facility and an emergency disconnection connecting device comprising two elements which can separate automatically in a direction of separation d when a separation force greater than a threshold is exerted, the convex guide surface being arranged in relation to the emergency disconnection connecting devices in such a way that when the pulling forces acting between the first and second ends of the flexible pipes press the flexible pipes against the convex guide surface the directions of separation d in which the separable elements separate extend tangentially to said convex guide surface so that the pulling forces act on the emergency disconnection connecting devices in the direction of separation d.

12. The system as claimed in claim 11, wherein for each flexible pipe the convex guide surface comprises a guide groove, each of the guide grooves being edged by separating walls.

13. The system as claimed in claim 1, wherein the guide element is in the shape of a hollow bell portion comprising a summit equipped with an opening for passage of the flexible pipes.

14. The system as claimed in claim 1, wherein the guide surface is covered with a non-stick coating.

15. The system as claimed in claim 1, wherein the guide surface is fitted with a plurality of rollers mounted so as to rotate.

16. The system as claimed in claim 1, comprising a braking device to control the rate of fall of the flexible pipe during emergency disconnection, the braking device comprising:

a drum;

a cable wound around the drum and also attached to one of the separable elements of the emergency disconnection connecting device;

a shaft, which can move in rotation, associated with the drum so that rotation of the drum in a direction in which the cable unwinds causes the shaft to rotate;

a metering pump fitted with a rotor rotationally coupled to the shaft; and a closed-loop hydraulic circuit associated with the metering pump and fitted with a flow regulator.

17. The system as claimed in claim 16, comprising a plurality of fluid transfer lines extending along the mast and a plurality of flexible pipes each comprising a first end connected to the fluid transfer line, a second end intended to be connected to a manifold of the facility and an emergency disconnection connecting device comprising two elements capable of separating automatically; the braking device comprising for each flexible pipe a drum and a cable wound around said drum and firmly attached to one of the separable elements of the emergency disconnection connecting device of said flexible pipe; each drum being associated with the shaft by means of a device having a wheel free to move in one direction or non-return device such that rotation of the drum in a direction in which the cable unwinds causes the shaft to rotate in a first direction of rotation and that the shaft can turn freely in the first direction of rotation without causing the drum to rotate in the direction in which the cable unwinds.

18. The system as claimed in claim 16, wherein one end of the cable is attached to a pin, the drum comprising a groove for housing said pin.

19. The system as claimed in claim 16, further comprising an emergency disconnection detection device capable of detecting rotation of the drum of the braking device and producing a detection signal when rotation of the drum is detected.

20. The system as claimed in claim 19, wherein the emergency disconnection detection device is arranged to produce an alarm signal and/or a signal stopping a pump intended to ensure the transfer of fluid between the ship and the facility through the fluid transfer line and the flexible pipe.

21. A ship equipped with a transfer line as claimed in claim 1.

22. A process for the transfer of a fluid between a ship and a facility by means of a transfer system as claimed in claim 1, wherein during the transfer operation the mast is positioned in a position such that when a pulling force is exerted between the first end and the second end of the flexible pipe, said flexible pipe is pressed against the convex guide surface.

23. The process for the transfer of a fluid as claimed in claim 22, comprising an operation of draining the flexible pipe in which the mast is moved into a position in which the flexible pipe follows a descending slope from the mast toward the manifold of the facility so that fluid present within the flexible pipe can flow by gravity.

* * * * *